United States Patent [19]

Ernest et al.

[11] Patent Number: 4,598,437

[45] Date of Patent: Jul. 8, 1986

[54] MODULAR ORAL HYGIENE SYSTEM

[76] Inventors: Raymond Ernest, 1612 NE. 105th St., Miami Shores, Fla. 33138; Stephen J. Ginsburg, 7 Lehigh Rd., Wellesley, Mass. 02181

[21] Appl. No.: 642,824

[22] Filed: Aug. 21, 1984

[51] Int. Cl.[4] ..... A46B 9/04

[52] U.S. Cl. ..... 15/176; 15/145; 15/167 R

[58] Field of Search ..... 15/143 R, 144 R, 145, 15/167 R, 167 A, 110, 176, 172; D4/104, 112, 113

[56] References Cited

U.S. PATENT DOCUMENTS

| | | | |
|---|---|---|---|
| 490,831 | 1/1893 | Lohers . | |
| 541,727 | 6/1895 | Dennis . | |
| 1,813,630 | 7/1931 | McCarty | 15/22 A |
| 2,094,240 | 9/1937 | Herrick et al. | 15/167 R |
| 2,934,776 | 5/1960 | Clemens | 15/167 R |
| 3,065,480 | 11/1962 | Sexton . | |
| 3,072,944 | 1/1963 | Clayton et al. . | |
| 3,672,377 | 6/1972 | Greenacre | 15/176 X |
| 3,978,852 | 9/1976 | Annoni . | |
| 4,209,871 | 7/1980 | Ernest et al. . | |
| 4,227,276 | 10/1980 | Ginsburg et al. . | |
| 4,330,896 | 5/1982 | Booth . | |
| 4,399,582 | 8/1983 | Ernest et al. . | |
| 4,461,053 | 7/1984 | Nitzsche et al. | 15/176 X |

FOREIGN PATENT DOCUMENTS

| | | | |
|---|---|---|---|
| 443435 | 9/1912 | France . | |
| 132737 | 7/1929 | Switzerland | 15/110 |
| 216355 | 5/1924 | United Kingdom . | |
| 245880 | 1/1926 | United Kingdom | 15/172 |
| 2035073 | 6/1980 | United Kingdom . | |

*Primary Examiner*—Peter Feldman

*Attorney, Agent, or Firm*—Sherman and Shalloway

[57] ABSTRACT

An oral hygiene device comprising a detachable head and a handle into which the detachable head can be inserted. A plurality of detachable heads each having a different oral hygiene means thereon is also provided. The detachable heads and the handle form a system for complete oral hygiene home care unit.

13 Claims, 20 Drawing Figures

Fig. 2A
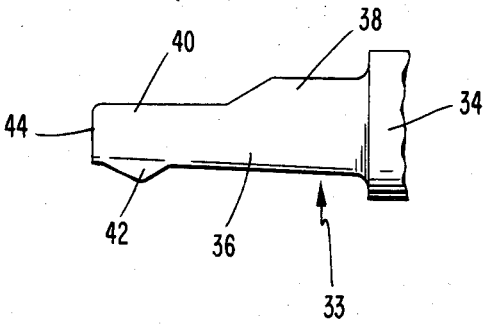
Fig. 2B
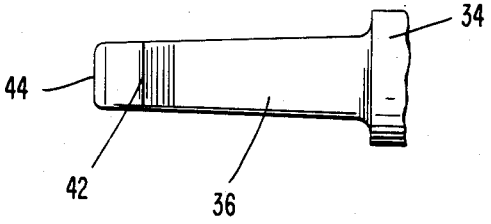
Fig. 3A
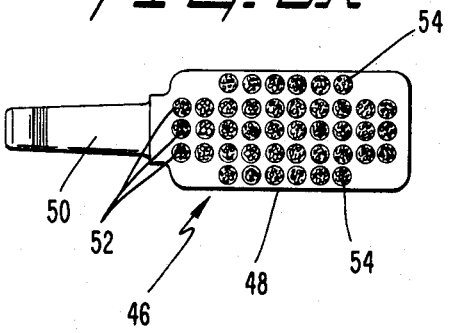
Fig. 3B
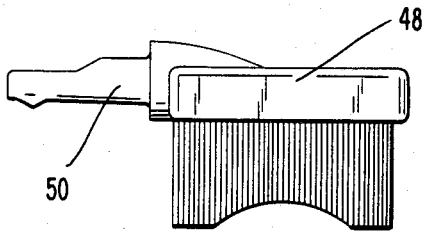
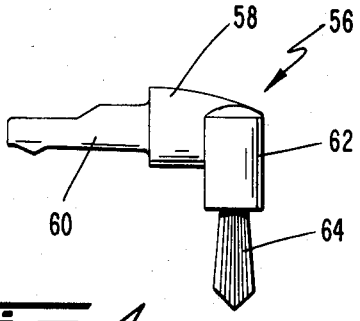
Fig. 4
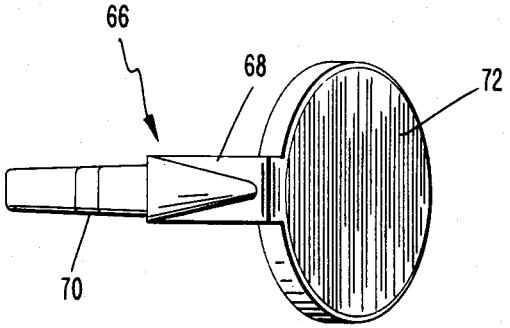
Fig. 5B
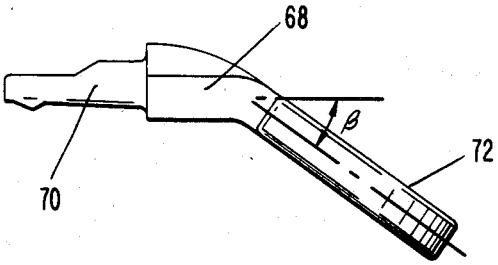
Fig. 5A Fig. 6
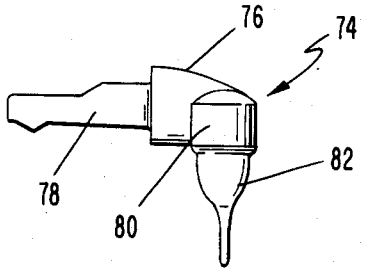
Fig. 7A
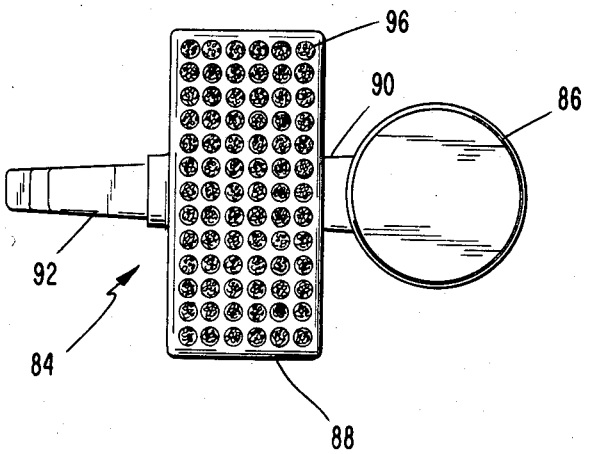
Fig. 7B
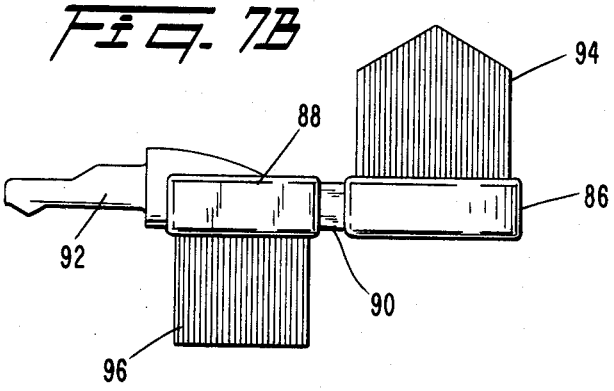
Fig. 8A
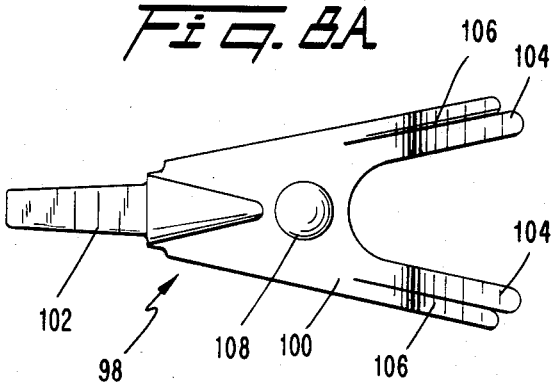
Fig. 8B
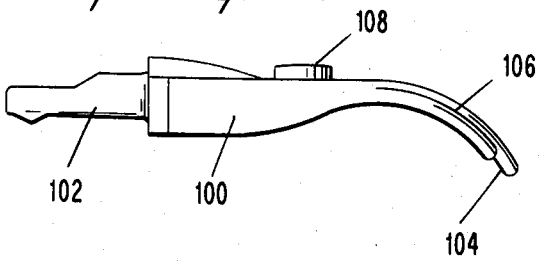
Fig. 9A
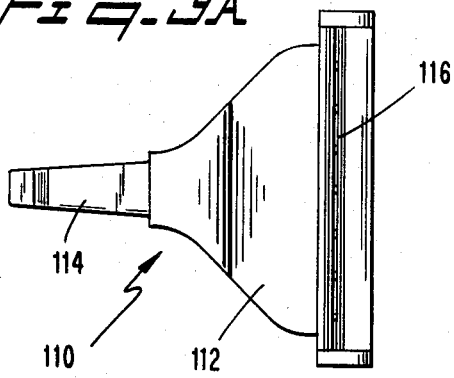
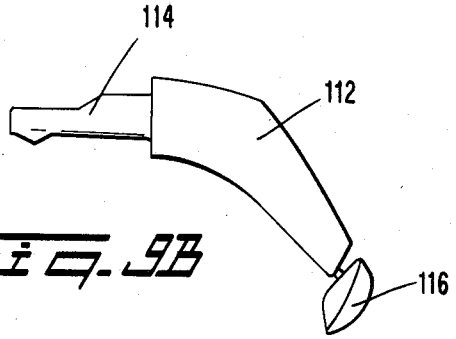
Fig. 9B

MODULAR ORAL HYGIENE SYSTEM

BACKGROUND OF THE INVENTION

1. Field of Invention

This invention relates to oral hygiene devices and more particularly to a system of oral hygiene devices of various configurations designed for improved cleaning of the mouths of a wide variety of individual patients.

2. Description of the Prior Art

It is currently recognized that while it is desirable with each brushing of the teeth to remove as much bacterial plaque as possible from the interproximal spaces and from beneath the free gingival margin as well as from the surfaces of the teeth, the bacteria in the plaque which are responsible for tooth decay and gingival deterioration are inactivated for periods of time up to twenty-four hours by isolation of the bacteria from their grouping in a plaque form, that is, by disturbing the plaque formed on the teeth and breaking up the grouping of the bacteria. Accordingly, it is being urged that teeth be brushed in a rotary motion in an attempt to reach beneath the free gingival margin rather than in a reciprocating movement parallel to the occlusal plane and also by such rotary motion to avoid tooth structure erosion caused by reciprocating brushing.

Inasmuch as the structures of the toothbrushes currently available do not promote the use of the desired rotary brushing motion nor provide means to facilitate reaching into the interproximal spaces and beneath the free gingival margin, there is a present need to provide a toothbrush which will not only discourage brushing parallel to the occlusal plane and encourage as well as facilitate the desirable rotary brushing movement, but will also provide means for reaching the interproximal spaces and beneath the free gingival margin.

Several proposals have been advanced to provide increased access to interproximal and free gingival margin areas of teeth. Significant among these is U.S. Pat. No. 4,209,871 to Ernest, that patent being hereby incorporated by reference. While the above-mentioned U.S. Pat. No. 4,209,871 discloses a toothbrush having a head which provides increased accessability to the teeth, the specialized nature of the brush head meant that it would be difficult to provide the brush in a wide variety of configurations.

Additionally, a good home dental program may require the use of different toothbrush designs. For example, if a patient brushed twice daily, he may wish to use a brush which is adapted to maximize cleaning of gingival areas in the morning and use a brush which maximizes cleaning of interproximal areas before he retires. In certain instances, a dentist may wish to prescribe the use of a certain type of toothbrush, such as a toothbrush designed to treat certain periodontal disorders.

While the primary function of a toothbrush is cleaning, toothbrushes are notoriously septic by their very nature. Macro and microscopic particles are often lodged between bristles. Likewise, particularly in humid climates, the bristles tend to remain septically moist for long periods of time at room temperatures, often until the next use of the toothbrush.

People have used various techniques in order to avoid septic conditions. In addition to vigorously rinsing the toothbrush before and after each use, people often use multiple toothbrushes, permitting a longer period of inactivity to exist between uses of a particular toothbrush. Septic conditions have also discouraged the use of toothbrush designs in which large amount of bristles are used because these large amounts of bristles makes it difficult to obtain dry condition of the toothbrush head.

Various disposable toothbrush designs have been advanced in the prior art. Notable among these is U.S. Pat. No. 4,227,275 to Ginsburg, et al., invented in part by one of the co-inventors of the present invention; that patent being hereby incorporated by reference.

The above-mentioned U.S. Pat. No. 4,227,276 discloses the use of a removable handle which may be re-formed when heated in hot water. This presents a partial solution to another problem in the prior art, that is the custom tailoring of toothbrush handles to the individual user.

While particular shapes of toothbrush handles may be more desirable, it may be also desirable to provide toothbrush handles which may be of particular highly specialized or expensive variety with the brushes being disposable.

It may also be desired to provide toothbrushes with handles which would be used for a variety of user applications. For example, if a user desired to use a toothbrush while spending the night away from home, she may wish to have the convenience of portability. She may also wish to have the convenience of using a particular toothbrush head configuration. If she is visiting someone whom she knows has an electric toothbrush handle, she may wish to have a handle which, if circumstances allow, permit her to attach her toothbrush to the electric toothbrush handle in conditions which are reasonable aseptic.

U.S. Pat. No. 3,994,039 discloses various methods for brushing teeth, that patent being hereby incorporated by reference. These methods include various combinations of back-and-forth movement and vertical brush movement designed to effectively clean the teeth and provide circulation at the gingival margin. In a similar matter, electric toothbrushes have been designed to provide various brush movements, primarily in an attempt to provide brushing action recommended by dentists. These include, in addition to vertical and horizontal movements, vertical rolling movements and combinations of horizontal and rolling movements. Recently, a short circular movement has received widespread acceptability in the dental profession. These diverse movements have been generally designed to be used with a single brush, usually having a simple rectangular or round shape, with little attention to improving brush design as well.

U.S. Pat. No. 4,399,582 issued to the present co-inventors discloses a toothbrush system wherein a plurality of disposable heads may be inserted into a disposable stem. The system permits the head and stem designs to be custom tailored to an individual patient's needs relative to mouth size, brushing comfort and dental and periodontal needs.

Although numerous toothbrush designs have been suggested in the above-cited patents, there is no disclosure relating to an oral hygiene system wherein a handle can be used with a plurality of detachable heads to provide the user with a total system of dental care whereby the user may clean his/her teeth using particular brushes, floss the teeth using a dental floss holder and examine the teeth using a dental mirror.

SUMMARY OF THE INVENTION

The present invention provides an oral hygiene device comprising a detachable head and a handle into which the detachable head can be inserted. The detachable head comprises a body portion having provided thereon an oral hygiene means and a male extension adapted for retaining the detachable head in the handle. The detachable head may be provided with a toothbrush, sulci area brush, dental floss holder, dental mirror, denture brush or gum massager.

The present invention further provides a system of disposable oral hygiene devices comprising a handle and various detachable heads, each having thereon a toothbrush, sulci area brush, dental floss holder, dental mirror, denture brush and gum massager.

The present invention further provides a disposable safety razor comprising a handle and a detachable head having provided thereon a safety razor, the detachable head capable of being inserted into the handle.

BRIEF DESCRIPTION OF THE DRAWINGS

FIG. 2A shows a front view of the present detachable head.

FIG. 2B details the construction of the male extension in FIG. 2.

FIG. 3A shows a top view of a detachable head embodying a toothbrush.

FIG. 3B shows a side view of the detachable head of FIG. 3.

FIG. 4 shows a side view of a detachable head embodying a brush adapted for cleaning sulci areas.

FIG. 5A shows a top view of a detachable head embodying a dental mirror.

FIG. 5B illustrates a side view of the detachable head of FIG. 5.

FIG. 6 illustrates a side view of a detachable head embodying a gum massager.

FIG. 7A shows a top view of a detachable head embodying a denture brush.

FIG. 7B shows a side view of the denture brush of FIG. 7A.

FIG. 8A details a top view of a detachable head embodying a dental floss holder.

FIG. 8B shows a side view of the detachable head of FIG. 8A.

FIG. 9A illustrates a top view of a detachable head embodying a razor.

FIG. 9B shows a side view of the detachable head of FIG. 9A.

DETAILED DESCRIPTION OF THE PREFERRED EMBODIMENT

According to the present invention, an oral hygiene device comprising a handle which is so designed to fit most users' hand and a detachable head having disposed thereon an oral hygiene means, the detachable head being insertable into the handle is provided. Various dental hygiene means such as toothbrush, gum massager, dental floss holder, sulci area brush, dental mirror and denture brush may be provided on the detachable head. In addition, a safety razor may be disposed on the detachable head to form a disposal razor.

Figure 1A:
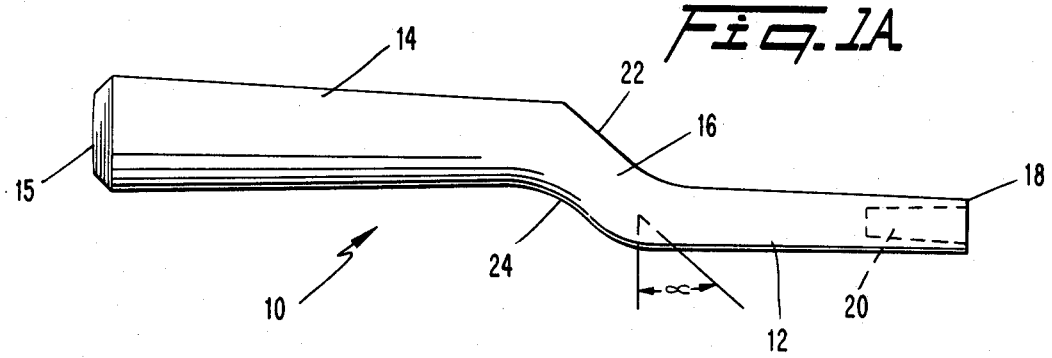
FIG. 1A illustrates a plan view of the present handle.

With reference to the drawings, FIG. 1A illustrates the handle 10 of the present invention which comprises three portions, a front portion 12, a rear portion 14 and a connecting portion 16. The longitudinal axes of front portion 12 and rear portion 14 are generally in parallel. The longitudinal axis of connecting portion 16 forms an angle $\alpha$ of about 30 to about 50 degrees, preferably about 35 to about 45 degrees, most preferably 40 degrees, with those of portions 12 and 14. The free end 18 of front portion 12 is provided with an opening or socket 20 into which the detachable head may be inserted. The front portion 12 constitutes about 35 to 40% of the overall length of handle 10, connecting portion 16 about 8 to 12% and rear portion 14, about 50 to 54%.

Figure 1B:
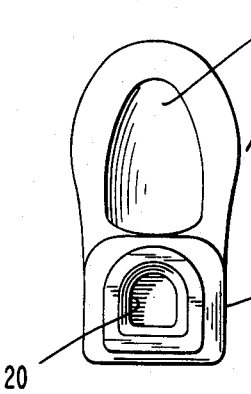
FIG. 1B illustrates the right end view of the present handle.
Figure 1C:
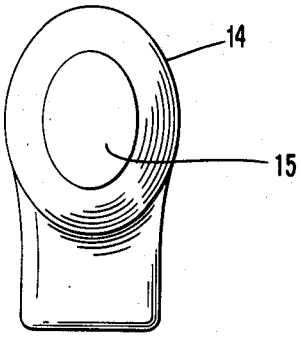
FIG. 1C shows the left end view of the present handle.
Figure 1D:
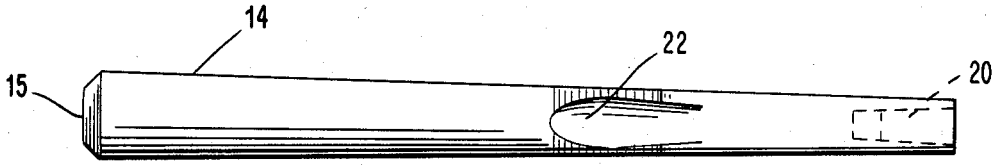
FIG. 1D shows a top view of the present handle.

As shown in FIG. 1B, front portion 12 has a generally square cross-sectional configuration. As to rear portion 14, it has a generally oval cross-sectional configuration which is shown in FIG. 1C. The top and bottom surfaces 22 and 24 of connecting portion 16 are indented to form thumb and finger rests, respectively, for the user's hand. Such indentations are shown in more detail in FIGS. 1D and 1E wherein FIG. 1D shows the bottom view and FIG. 1E, the top view. Of course, all of the edges in the handle are smooth in order to avoid injury to the user. The cross-sectional area of the handle decreases from a maximum at the butt end 15 of the rear portion to a minimum at the free end 18 of front portion 12.

Figure 1E:
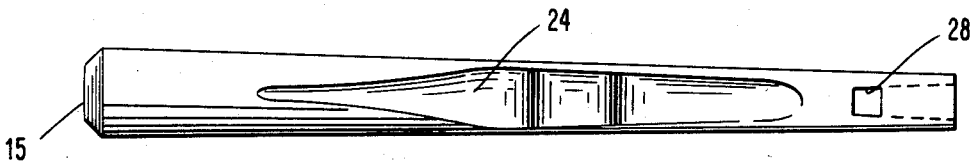
FIG. 1E shows a bottom view of the present handle.
Figure 1F:
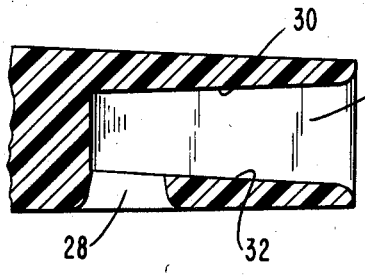
FIG. 1F illustrated the socket in the free end of the present handle.

FIG. 1F shows the construction of socket 20 in free end 18 of front portion 12. Socket 20 comprises a main tapered opening 26 in communication with side opening 28. Walls 30 and 32 of opening 26 are inclined to define a tapered opening, with the largest cross sectional area being at the free end 18 of the handle 10. Side opening 28 is provided primarily for engaging a projection or male extension on the detachable head to provide a firm hold on the detachable portion. The length of tapered opening 26 is about 10 to 14% of the overall length of the handle. As shown in FIG. 1E, side opening 28 is provided on the same side as bottom surface 24 of handle 10.

The present handle has an overall length of about 5 to 6 inches. Thus, from the butt end 15 of the handle, rear portion 14 extends horizontally for a length of about 3 inches at which point it descends at an approximately 40 degree angle for about 0.5 inch, and continues horizontally again for a length of about 2 inches where it terminates at free end 18 of front portion 12. The width of the handle from a lateral view tapers from about 0.7 inches at the butt end 15 to about 0.32 inches at the free end 18. The thickness or height of the handle is also tapered from the butt end 15 to free end 18. In this connection, the height starts at about 0.5 inch and decreases to about 0.32 inch. The contour of the handle is such that there are no sharp corners or protrusions which would injure the tissues of the user's hand or mouth and that the handle is easy and comfortable to hold. The shape and size are so designed that the handle fits the hand of an average adult or child. In addition, the handle's shape is designed to easily reach the interproximal areas of the mouth and to provide proper finger and thumb positions for easily controlled oral hygiene use. It will be readily appreciated that the bulk of the handle and the particular angular result in a favorable torque which allows the best results for all attachments that need pressure without bending of the handle.

The detachable head 33 used in conjunction with the above described handle comprises in general a body portion 34 (shown in part only) and a male extension 36, as shown in FIG. 2A. Body portion 34 may be provided with one of various oral hygiene means such as toothbrush, dental floss holder, dental mirror, gum massager, denture brush and sulci area brush. Each of these means will be discussed hereinbelow.

Male extension 36 in turn comprises a main section 38 disposed adjacent to body portion 34 and an end portion 40 having a reduced cross-sectional area. At the tip of end portion 40 is provided a projection 42. The small cross-sectional area in the end portion 40 ensures a wedge fit into socket 20 of handle 10. Projection 42 is adapted to extend into lateral opening 28 in handle 10 to lock detachable head 33 onto handle 10. Of course, detachable head 33 can be "snapped" off from handle 10 by pulling the head away from the handle. Thus, the male extension 36 is so constructed that a tight fit is attained between detachable head 33 and handle 10. The overall length for male extension 36 is about 0.66 inches. The thickness of the main section adjacent the body portion 34 is about 0.23 inch and that of the end portion at tip 44 is about 0.18 inch. As shown in FIG. 2A, male extension is tapered, i.e. the width of male extension 36 starts at about 0.2 inch adjacent to body portion 34 and decreases to about 0.15 inch at tip 44.

Each of the various oral hygiene means which may be provided in body portion 34 of detachable head 33 is now described. It is understood that all of the detachable heads are formed with a male extension having a construction similar to that shown in FIGS. 2A and 2B. When in use, the detachable head is inserted into the handle to form an oral hygiene device or safety razor.

FIG. 3A shows a detachable head 46 which comprises body portion 48 and male extension 50. Body portion 48 is in the general shape of a flat rectangular plate, with its longitudinal axis being aligned with male extension 50 and handle 10. On the working or brush side of body portion 48, five longitudinal rows of tufts are provided to form a toothbrush. As shown in FIG. 3A, the inner three rows 52 of tufts have ten tufts or bundles of bristle in each row whereas the two outer rows 54 of tufts have six tufts in each row. Since the inner rows 52 have more tufts per row than the outer rows 54, the inner rows of tufts located at the two ends extend symmetrically beyond those of the outer rows.

The male extension 50 for detachable head 46 is similar in construction to that disclosed in FIGS. 2 and 2A.

The detachable head of FIG. 3A may be inserted into handle 10 of FIG. 1A to form a toothbrush which is used with a massaging motion to the long axis of the teeth. Since the tufts are disposed along the longitudinal axis of the handle, one arch is brushed at a time on the cheek side of the teeth and on the tongue side of the teeth. The toothbrush so disclosed is still considered to be an "interproximal" brush because of the placement of the tufts which breaks up bacterial plaque in an effective manner. Due to the particular configuration of the handle, the thumb and finger positions will always be approximatly the same on the defined areas of the handle.

FIG. 3B shows another embodiment of a toothbrush disposed on the detachable head. In this embodiment, the bristles disposed near the middle of the toothbrush have shorter lengths to provide a curved profile in a lateral view to fit the curvature of the outer surface of a tooth. As shown in FIG. 3B, the bristles at the outer ends have a length of about 0.5 inch whereas those near the center have a length of about 0.35 to 0.4 inch. Of course, a toothbrush wherein all the bristles have the same length to define a flat profile can also be provided in lieu of the curved profile on body portion 48.

FIG. 4 illustrates a detachable head wherein a brush for cleaning the interproximal spaces, i.e. areas in between the teeth is provided. Detachable head 56 comprises body portion 58 and male extension 60 which is similar to that shown in FIGS. 2A and 2B. Body portion 58 is connected to housing 62 from which a single large tuft 64 extends. When in use, detachable head 56 is inserted into handle 10 to form a brush which is specifically for cleaning the interproximal spaces, i.e. spaces between the teeth. This brush is particularly effective in sulci areas or interproximal areas which have been deepened by gingival disease or by molar alignment of teeth. The brush is used in a rotary massage motion at right angles to the inbetween spaces of the teeth to break up and remove bacterial plaque.

The detachable head of the present invention can also be formed with a dental mirror. As shown in FIG. 5A, detachable head 66 comprises body portion 68 and male extension 70. Body portion 68 is provided with dental mirror 72 which forms an angle $\beta$ of about 30 degrees with body portion 68. Mirror 72 has such a size that it can be easily maneuvered within the user's mouth. As to male extension 70, its construction is shown in FIGS. 2A and 2B. When in use, detachable head 66 is inserted into handle 10 to form a dental mirror which can be maneuvered easily to allow the user a clear view of his/her teeth. The angular disposition of the mirror 72 enables the user to see the rearward facing parts of his/her teeth.

FIG. 6 illustrates a gum massager which is provided on the detachable head of the present invention. Detachable head 74 comprises body portion 76 and male extension 78 which has a construction similar to that shown in FIGS. 2A and 2B. Body portion 76 comprises a housing 80 from which a gum massager 82 in the form of a pointed cone extends. Usually, gum massager 82 is formed of a rubbery material.

FIGS. 7A and 7B shows a denture brush detachable head 84 for use with handle 10. In this embodiment, detachable head 84 comprises male extension 92 and front and rear portions 86 and 88, respectively, joined by connecting section 90. Although front body portion 86 is shown to be circular and rear body portion 88, rectangular, the general shapes of these body portions are not significant. As shown in FIGS. 7A and 7B, a plurality of tufts 94 are disposed on front body portion 86. Tufts 96 are also provided on rear body portion 88 but on a surface opposite to that of tufts 94. The bristles on front body portion 86 have a greater length than those on rear body portion 88. The front portion 86 is for cleaning the inside of a full or partial denture and the rear portion 88 is for cleaning the outside of the denture. Tufts 94 in the front portion 86 are arranged in the shape of a rhombus as follows. Seven longitudinal rows of tufts are used. The center row has six tufts. On each side of the center row is a row of five tufts. A row of four tufts is placed outside each of the row of five tufts. The outermost row on each side has twb tufts. In rear portion 88, there are also seven longitudinal rows of tufts, each row having five tufts. The tufts in either front or rear portions 86 and 88 may have the same length. Optionally, the tufts may have a shorter length in the middle part of the brush to form an arc to fit the curvature of a tooth. The arc may be along the longitudinal or transverse axis of the detachable head. Male extension 92 has a construction similar to that shown in FIGS. 2A and 2B.

The detachable head can also be formed into a dental floss holder for use in conjunction with the handle 10. As shown in FIGS. 8A and 8B, detachable head 98 comprises a body portion 100 and male extension 102. Body portion 100 is generally in the shape of the letter "V" and comprises two arms 104 which are spaced apart. Each arm is provided with a slit 106 into which the floss may be fed. Optionally, a disc 108 may be formed in body portion 100 for anchoring the floss. In this case, the floss is first wound around disc 108 to anchor one end of the floss. Thereafter the floss is fed through slit 106 on one arm, across the space between the arms 104 and then through the slit on the other arm. The floss is then wound around disc 108 to anchor the free end of the floss. As shown in FIG. 8B, arms 104 may have a curved profile to allow easier application of the dental floss holder.

The construction of male extension 102 is similar to that shown in FIGS. 2A and 2B.

The present handle can also be used in connection with a detachable head having provided therein a safety razor. Such a detachable head is shown in FIGS. 9A and 9B wherein reference numeral 110 refers to the detachable head. Detachable head 110 comprises body portion 112 and male extension 114. The forward end of body portion is connected to a safety razor 116. Any conventional safety razor may be used in connection with the present detachable head. As shown in FIG. 9B, body portion 112 forms an angle of about 45° with the longitudinal axis of male extension 114 to provide a more comfortable shave. Safety razor 110 is intetrally formed for insertion into free end 18 of handle 10.

The present handle and detachable head may be formed of any suitable material such as Nylon, polypropylene etc. Any conventional method such as injection moulding may be used to form the handle and detachable heads. Typically, the handle is of one piece construction as well as the detachable head.

What is claimed is:

1. An oral hygiene device comprising a detachable head and a handle into which the detachable head can be inserted, said detachable head comprising a body portion having provided thereon an oral hygiene means and a male extension comprising a main section disposed adjacent to said body portion and an end portion having a reduced cross-sectional area, said end portion having at the tip a projection adapted for retaining said detachable head in said handle;

said handle comprising generally parallel front and rear portions connected by a middle portion which forms an angle of about 30 to about 50 degrees with said front and rear portions, the free end of said front portion being provided with a socket to receive the male extension of said detachable head, the upper and lower surfaces of the middle portion being indented to form thumb and finger rests, the front and rear portions having about the same length, said rear section having a generally oval cross-section to fit a user's hand, said handle having a decreasing cross-sectional area from the rear portion to the front portion.

2. The device of claim 1 wherein said body portion is in the general shape of a flat rectangular plate with its longitudinal axis being aligned with that of the handle and said oral hygiene means comprises a toothbrush having five parallel rows of tufts disposed along the longitudinal axis of said rectangular plate, the center three rows each having ten tufts and the center two rows each having six tufts.

3. The device of claim 2 wherein the outer two rows of tufts are disposed near the middle section of said body portion.

4. The device of claim 3 wherein the tufts have the same length.

5. The device of claim 3 wherein the tufts decrease in length to a minimum along the longitudinal axis of the plate and near the central portion of the toothbrush.

6. The device of claim 1 wherein said oral hygiene means comprises a generally conical shaped gum massager.

7. The device of claim 1 wherein said oral hygiene means comprises a dental mirror and said body portion of said detachable heads form an angle of about 30 degrees with said attachment means.

8. The device of claim 1 wherein said oral hygiene means compprises a toothbrush having a tuft of bristles adapted for cleaning the sulci areas.

9. The device of claim 1 wherein said detachable head has first and second body portions connected by a connecting section, said first body portion being disposed between said connecting portion and said male extension and having on the same surface as the projection a plurality of rows of tufts, said second body portion having on the surface opposite to the projection a plurality of rows of tufts.

10. The device of claim 1 wherein said body portion of said detachable head comprises two separated arms, each arm having a slit therein for the passage of a dental floss.

11. A handle for use in connection with an oral hygiene means comprising generally parallel front and rear portions connected by a middle portion, said middle portion forming and angle of about 30 to about 50 degrees with said front and rear portions, the free end of said front portion being provided with a socket to receive the male extension of a detachable head having thereon an oral hygiene means, the upper and lower surfaces of the middle portion being indented to form thumb and finger rests, the front and rear portions having about the same length, said rear section having a generally oval cross-section to fit the user's hand, said handle having a decreasing cross-sectional area from the rear portion to the front portion.

12. A disposable razor comprising the handle of claim 11 having a safety razor provided on the detachable head insertable into the handle.

13. A disposable oral hygiene system comprising the handle of claim 11 and a plurality of detachable heads, each detachable head comprising a body portion having provided thereon an oral hygiene means and a male extension comprising a main section disposed adjacent to said body portion and an end portion having a reduced cross-sectional area, said end portion having at the tip a projection adapted for retaining said detachable head in said handle, one detachable head being in the general shape of a flat rectangular plate with its longitudinal axis being aligned with that of the handle and having disposed on one surface a toothbrush having five parrallel rows of tufts disposed along the longitudinal axis of said rectangular plate, the center three rows each having ten tufts and the center two rows each having six tufts;

one detachable head having disposed thereon a generally conical shaped gum massager;

one detachable head having disposed thereon a dental mirror and said body portion of said detachable heads forms and angle of about 30 degrees with said male extension;

one detachable head having disposed thereon a toothbrush having a tuft of bristles adapted for cleaning the sulci areas;

one detachable head having first and second body portions connected by a connecting section, said first body portion being disposed between said connecting portion and said male extension and having on the same surface as the projection a plurality of rows of tufts, said second body portion having on the surface opposite to the projection a plurality of rows of tufts; and one detachable head having two separated arms, each arm having a slit therein for the passage of a dental floss.

* * * * *